United States Patent [19]

Fehlmann et al.

[11] 4,063,148

[45] Dec. 13, 1977

[54] FIRST HOUSE PROTECTOR FOR VOLTAGE REGULATORS AND THE LIKE

[75] Inventors: Hans R. Fehlmann, Lenox; Richard D. Blackburn, Dalton, both of Mass.

[73] Assignee: General Electric Company

[21] Appl. No.: 701,521

[22] Filed: July 1, 1976

[51] Int. Cl.[2] ..... G05F 1/64

[52] U.S. Cl. ..... 323/43.5 S; 361/89; 361/90; 361/187

[58] Field of Search ..... 323/43.5 R, 43.5 S; 317/36 TD, 49, 50, DIG. 5, 141 S; 361/89, 90, 187

[56] References Cited

U.S. PATENT DOCUMENTS

| | | | |
|---|---|---|---|
| 2,713,142 | 7/1955 | Sealey | 323/43.5 R |
| 3,128,424 | 4/1964 | Cooley et al. | 323/43.5 R |
| 3,784,846 | 1/1974 | Krick et al. | 317/36 TD |
| 3,906,248 | 9/1975 | Vieira | 317/141 S |

OTHER PUBLICATIONS

First House Voltage Protector Supplement to GEA 7534 Pub. May 1970.

First House Voltage Protector GE Brochure, Dec. 1972.

*Primary Examiner*—Gerald Goldberg

[57] ABSTRACT

A control circuit for limiting the output voltage of a voltage regulator or the like to a safe level for consumers connected close to the voltage regulator. The output voltage of the regulator is measured and compared to a reference. If the voltage exceeds the preset level then the circuit is energized to prevent further tap change that would increase the voltage output. A time delay is provided to prevent immediate de-energization of the circuit when the voltage drops below the preset level. Should line fluctuations cause further voltage increase, then the circuit will cause a tap change so as to reduce the output voltage. If the output voltage drops below a preset level then the circuit will prevent further tap changing which would cause any further lowering of the output voltage.

1 Claim, 2 Drawing Figures

FIRST HOUSE PROTECTOR FOR VOLTAGE REGULATORS AND THE LIKE

BACKGROUND OF THE INVENTION

This invention relates to voltage regulators and the like, and more particularly, to a control circuit to prevent excessive high- or low-voltage outputs from such regulator.

As is well known to those skilled in the electrical utility field, voltage regulators and other load tap changing equipment are used in distribution circuits to compensate for voltage drops along the distribution line and to assure proper voltage at a distant load center. However, during high load periods the consumers who are closest to the regulator experience higher than rated voltages. As is well known, some electrical equipment such as television receivers are impaired by exposure to higher than rated voltages. Thus, it is desirable to provide control means in conjunction with voltage regulating equipment to prevent overvoltage conditions on consumers who are closest to the regulating equipment.

Also, it is well understood that low voltage levels also has a harmful effect on other types of electrical equipment; thus, it is further desirable to provide control means in conjunction with voltage regulating equipment that will prevent such equipment from lowering the output voltage below the desired limit for consumers.

It is, therefore, a principal object of this invention to provide a control circuit for voltage regulating equipment to prevent excessive high- or low-voltage outputs from such equipment.

SUMMARY OF THE INVENTION

Briefly, in a preferred form, this invention comprises a control circuit for voltage regulating equipment to prevent undesired high- or low-voltage settings of the regulator. The control circuit comprises three limit devices to control the regulator. The first or upper limit comprises a potentiometer that can be preset to an upper voltage limit. If the output of the regulator increases over such preset limits, then the upper limit circuit will be actuated to prevent the tap changer drive motor from initiating further changes in the raise direction. If the output drops below the preset level, then the upper limit control circuit will be deactivated, after a preset time delay. The second, or run back circuit, provides means to cause the tap changer drive motor to reduce the voltage output should the output voltage increase beyond the preset upper limit due to any condition, such as an increase in source voltage to the regulator. The third or lower limit circuit includes a potentiometer preset at a lower voltage limit. If the output voltage drops below such preset lower limit then the circuit is actuated to prevent the tap changer drive motor from initiating tap changes which would lower the regulator output.

The invention which is sought to be protected will be particularly pointed out and distinctly claimed in the claims appended hereto. However, it is believed that this invention and the manner in which its various objects and advantages are obtained as well as other objects and advantages thereof, will be better understood by reference to the following detailed description of a preferred embodiment particularly when considered in the light of the accompanying drawings.

DESCRIPTION OF PREFERRED EMPODIMENT

This invention relates to a control circuit for voltage regulating equipment, often referred to as a first house protector. The preferred form of control circuit according to this invention is shown in the figures of the drawings in which like numerals are used to indicate like parts throughout.

Figure 1:
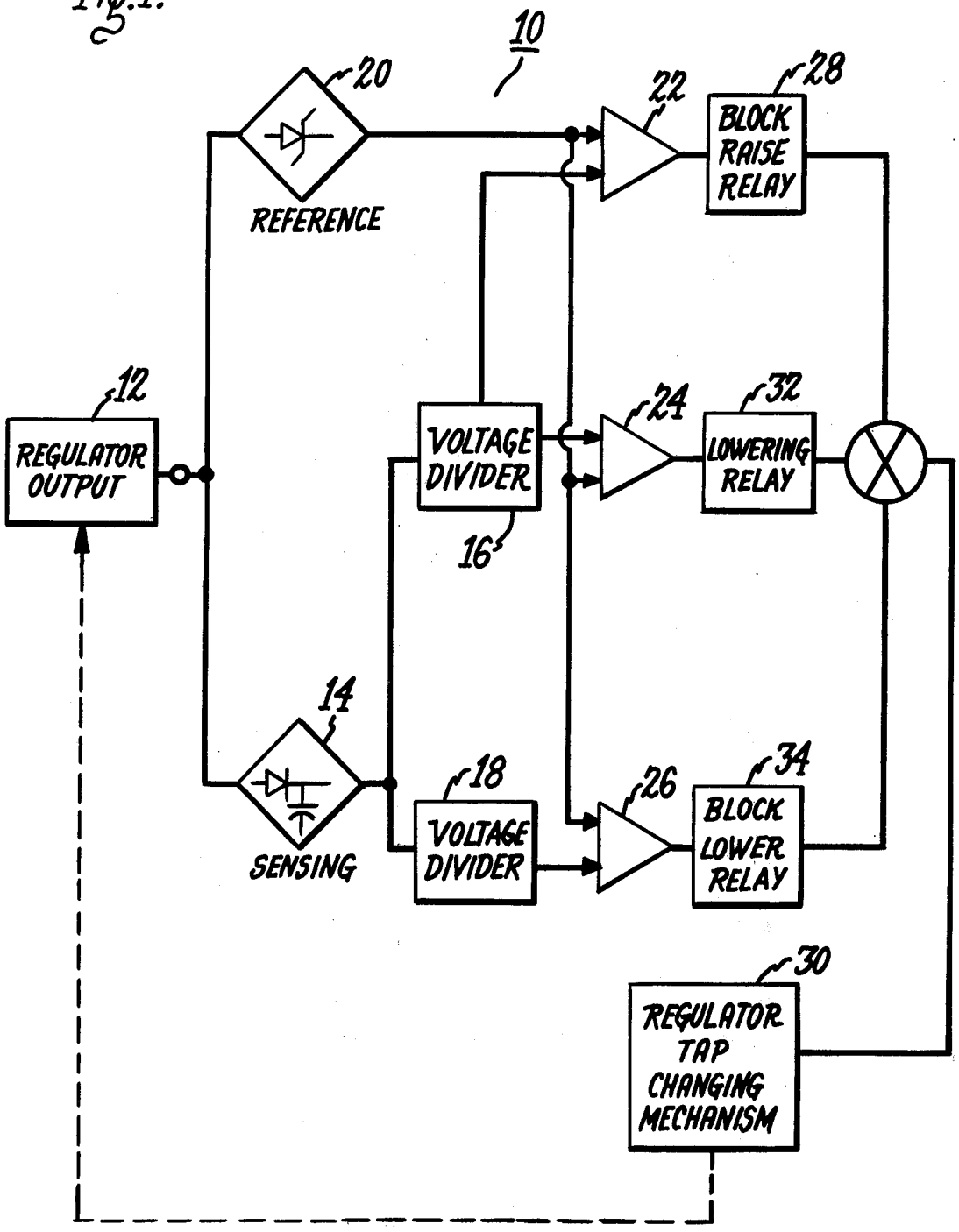
FIG. 1 is a block diagram of one form of control circuit according to this invention.

FIG. 1 shows a block diagram of the preferred control circuit generally indicated at 10. Control circuit 10 includes the regulator output circuit 12 which is fed through a voltage sensing amplifier circuit 14 to voltage dividers 16 and 18. The output voltage of dividers 16 and 18 is compared with reference voltage signals from circuit 20 in the sensing amplifiers 22, 24 and 26 as shown. If the voltage exceeds a preset upper limit relay 28 is energized through amplifier 22 to prevent the regulator tap changing mechanism 30 from initiating further changes in the raise direction.

If, due to source voltage variations, or load changes, the output voltage should increase a fixed percent above the preset upper limit then relay 32 is energized by amplifier 24. When relay 32 is energized it activates the tap changing mechanism 30 to lower the regulator output voltage. Should the regulator output voltage drop below a preset minimum voltage level then amplifier 26 will energize block lower relay 34. When block lower relay 34 is energized it will operate to prevent the tap changing mechanism 30 from initiating any changes to lower the output voltage of the regulator.

Figure 2:
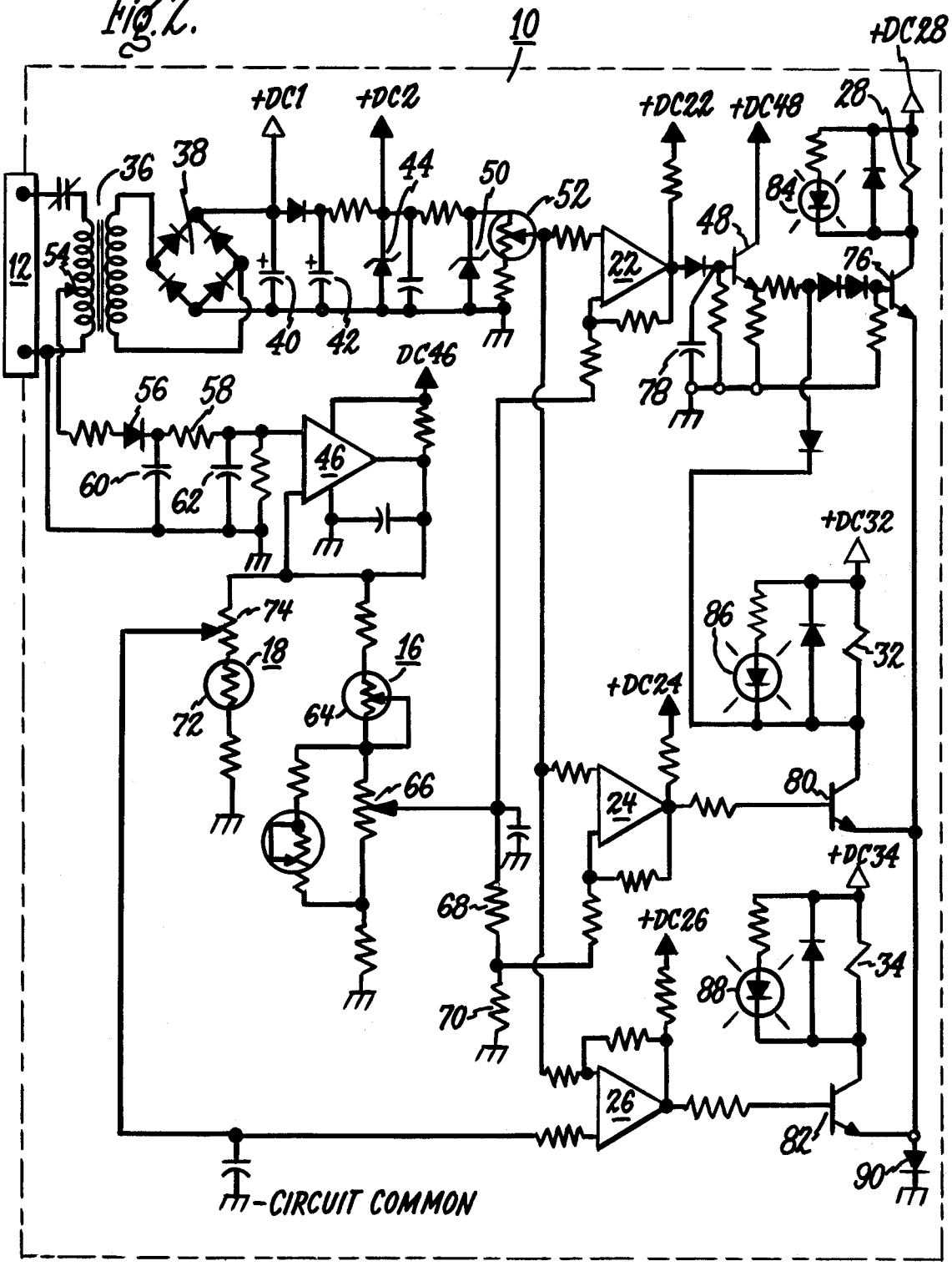
FIG. 2 is a schematic diagram of a preferred form of voltage regulating control circuit according to this invention.

FIG. 2 shows a schematic diagram of the present preferred control circuit 10. As shown a regulator output 12 is reduced by control transformer 36 and rectified and filtered through rectifier bridge 38 and capacitors 40 and 42. This rectified voltage indicated by the open arrow + DC 1 is the supply voltage for relays 28, 32, and 34 as is shown by the open arrows + DC 28, + DC 32, and + DC 34. The voltage developed across zener diode 44 indicated as + DC 2, is used as the DC supply voltage for amplifiers 22, 24, 26, and 46 as is shown by the solid arrows + DC 22, + DC 24, + DC 26, and + DC 46. It also provides a supply voltage for transistor 48 as shown by solid arrow + DC 48. The temperature stable reference zener diode 50 develops a voltage through trimmer potentiometer 52 which is used as a reference signal by amplifiers 22, 24, and 26 as is shown.

The output voltage 12 is also reduced by means of tap 54 on the primary of control transformer 36. This voltage is rectified and filtered by rectifier 56, resistor 58, and capacitor 60 and 62. It is then fed to the operational amplifier 46. The output voltage of amplifier 46 which directly follows the input voltage, is fed to the voltage divider circuits 16 and 18. Voltage divider 16 includes trimmer potentiometer 64 and level adjustment potentiometer 66. As will be apparent, potentiometer 66 provides the upper limit voltage setting which is applied to the upper limit operating amplifier 22. Through resistors 68 and 70 the desired percent increase voltage signal is applied to the lower operating amplifier 24. Voltage divider 18 includes the trimmer potentiometer 72 and the level adjustment potentiometer 74. As will be apparent from the circuit the potentiometer 74 provides the setting for the lower limit voltage which is applied to the lower limit operating amplifier 26.

The operation of the control circuit will now be described, still referring to FIG. 2. If the output voltage of the regulator exceeds the upper limit set by potentiometer 66, then the voltage at the positive input terminal of amplifier 22 will be higher than the reference voltage supplied to the other terminal of amplifier 22. Under these conditions amplifier 22 turns on and its output drives transistor 48. Transistor 48 turns on transistor 76. Transistor 76 will energize the relay 28. Relay 28 will open a contact in the regulator tap changing mechanism 30 to prevent operation which would raise the regulator output. While energization of relay 28 occurs without any time delay, a time delay is provided to prevent dropout of relay 28 due to line transient or the like. As can be seen in FIG. 2, capacitor 78 is charged up during an operation amplifier 22, and transistors 48 and 76. If the upper limit signal drops below the preset upper limit, amplifier 22 acts to turn off transistor 48. However, capacitor 78 will slowly discharge continuing transistor 48 in the conducting state. After approximately a 10-second delay, capacitor 78 will be sufficiently discharged to turn off transistor 48 and thus, transistor 76, thereby de-energizing relay 28.

If voltage variations from load changes should occur to increase the output voltage approximately 1 percent over the present upper limit, then amplifier 24 is turned on. Amplifier 24 will turn on transistor 80 which will energize the relay 32. Transistor 80 also turns off transistor 76 and de-energizes relay 28. Relay 32 operates a contact in the tap changing mechanism 30 causing the motor to drive in a direction to lower the voltage output. This action continues until the voltage level is low enough to turn off amplifier 24. Amplifier 24 will turn off transistor 80 allowing transistor 76 to again turn on and energize the blocking relay 28.

If the voltage output drops below the preset level of potentiometer 74 then amplifier 26 will be turned on. Amplifier 26 will turn on the transistor 82 which will energize the lower blocking relay 34. Relay 34 is provided with a contact in the tap changing mechanism 30 which will prevent the motor from driving the mechanism in a direction to lower the output voltage.

In the preferred embodiment shown, light-emitting diodes 84, 86, and 88 are connected across relays 28, 32, and 34 respectively. These light-emitting diodes 84, 86, and 88 provide an indicating light for the operation of their respective relays. Also, a diode 90 is provided connected to the circuit common as indicated which biases each of transistors 76, 80, and 82 to assure their turn off when the output of transistors 76, 80, and 82 to assure their turn off when the output of their respective amplifiers is low.

While there has been shown and described the present preferred embodiment of this invention it will of course be apparent to those skilled in the art that various changes may be made in the circuitry disclosed without departing from the invention. The spirit and scope of the invention includes all such changes as may fall within the invention as defined in the appended claims.

What is claimed as new and which it is desired to be secured by Letters Patent of the United States is:

1. A control circuit for limiting the output of voltage regulating equipment, such equipment including a drive means, said control circuit comprising:

a. means for sensing the output of voltage regulating equipment;

b. a first voltage divider fed by said sensing means;

1. said first voltage divider having means for setting a desired upper limit of the output, c. first operating means actuated by an overvoltage from said setting means of said first voltage divider;

d. first relay means, said first relay means energized by said operating means to block further operation of the drive of the voltage regulating equipment in a direction to increase the voltage output of the voltage regulating equipment and;

e. time delay means connected to said first operating means to prevent immediate de-energization of said first relay means when said divider voltage drops below said preset limit;

f. a second operating means, said second operating means actuated by a further overvoltage from said first voltage divider, said second operating means energizing a second relay, 1. said second relay effective to cause the drive means of the voltage regulating equipment to drive the voltage regulating equipment to reduce the output voltage, g. a second voltage divider, said second voltage divider having means for setting a desired lower limit of the output;

h. third operating means actuated by an undervoltage from said setting means of said second voltage divider;

i. and a third relay means energized by said third operating means to block further operation of the drive means of the voltage regulating equipment in a direction to lower the voltage output of the voltage regulating equipment.

* * * * *